US007013657B2

(12) United States Patent
Hwang et al.

(10) Patent No.: US 7,013,657 B2
(45) Date of Patent: Mar. 21, 2006

(54) ICE MAKER

(75) Inventors: Ji Sick Hwang, Suwon (KR); Vassili Leniachine, Kyungki-Do (KR); Nikolai Shpakovsky, Kyungki-Do (KR); Gil Hyoung Cho, Kyungki-Do (KR); Hyo June Kim, Kyungki-Do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/724,168

(22) Filed: Dec. 1, 2003

(65) Prior Publication Data

US 2004/0144108 A1 Jul. 29, 2004

(30) Foreign Application Priority Data

Jan. 25, 2003 (KR) ..... 10-2003-0005070

(51) Int. Cl.
*F25C 1/10* (2006.01)

(52) U.S. Cl. ..... 62/137; 62/353

(58) Field of Classification Search ..... 62/72, 62/137, 353
See application file for complete search history.

(56) References Cited

U.S. PATENT DOCUMENTS 2,510,400 A * 6/1950 Hurley ..... 62/137
2,531,087 A * 11/1950 Tharaldsen ..... 62/341
3,247,682 A * 4/1966 Jocobs ..... 62/344
3,308,632 A * 3/1967 Winfield, Jr. ..... 62/137
3,309,892 A * 3/1967 O'Connell et al. ..... 62/345
3,392,286 A * 7/1968 Young ..... 307/141
3,529,430 A * 9/1970 Bauerlein ..... 62/137
3,580,007 A * 5/1971 Bauerlein ..... 62/345
3,929,256 A * 12/1975 Solomon ..... 221/81
4,002,041 A * 1/1977 Canter ..... 62/137
6,418,736 B1 * 7/2002 Cover ..... 62/137

FOREIGN PATENT DOCUMENTS

KR 2000-21989 4/2000

* cited by examiner

*Primary Examiner*—William E. Tapolcai
(74) *Attorney, Agent, or Firm*—Staas & Halsey LLP

(57) ABSTRACT

An ice maker is capable of efficiently making and removing ice cubes. The ice maker includes first and second pulleys which are installed to be spaced apart from each other. A drive unit rotates the first and second pulleys. An ice making conveyor is wrapped around the first and second pulleys, and has a plurality of ice making parts which are concavely formed to contain water therein. An ice storage tray is provided under the ice making conveyor to store ice cubes dropping from the ice making parts. An ice level sensing unit functions to sense a level of the ice cubes stored in the ice storage tray, thus shutting off electricity. When the level of the ice cubes stored in the ice storage tray exceeds a predetermined level, an operation of the ice maker is stopped, thus preventing an excessive number of ice cubes from being stored in the ice storage tray.

5 Claims, 4 Drawing Sheets

ICE MAKER

CROSS-REFERENCE TO RELATED APPLICATIONS

This application claims the benefit of Korean Patent Application No. 2003-5070, filed Jan. 25, 2003 in the Korean Intellectual Property Office, the disclosures of which are incorporated herein by reference.

BACKGROUND OF THE INVENTION

1. Field of the Invention

The present invention relates, in general, to ice makers and, more particularly, to an ice maker capable of efficiently making and removing ice cubes.

2. Description of the Related Art

Generally, an ice maker is installed in a refrigerator or a vending machine to make ice cubes out of water which is supplied to the ice maker.

A conventional ice maker includes drive and driven pulleys which are installed to be spaced apart from each other by a predetermined distance. An ice making conveyor is wrapped around the drive and driven pulleys, and is provided with a plurality of ice making parts to contain water therein.

Further, a heater is installed at a predetermined position in the ice making conveyor. The heater applies heat to the ice making parts which face downward, thus removing the ice cubes from the lower ice making parts. An ice storage tray is provided under the ice making conveyor to store the ice cubes removed from the ice making parts.

Thus, when the ice cubes are formed in the ice making parts which face upward, the ice making conveyor is moved by the drive and driven pulleys to make the ice making parts having the ice cubes face downward. Thereafter, electricity is applied to the heater to generate heat. The ice cubes are removed from the ice making parts by the heat, prior to being stored in the ice storage tray.

However, the conventional ice maker has a problem in that the ice maker is designed to continuously make ice cubes, thus an excessive number of ice cubes are made when the ice maker continues operations after a proper point of time. In this case, the ice cubes overflow the ice storage tray.

SUMMARY OF THE INVENTION

Accordingly, it is an aspect of the present invention to provide an ice maker which is turned on or off according to an amount of ice stored in the ice storage tray.

Additional aspects and/or advantages of the invention will be set forth in part in the description which follows and, in part, will be obvious from the description, or may be learned by practice of the invention.

The above and/or other aspects are achieved by an ice maker, including first and second pulleys which are installed to be spaced apart from each other, a drive unit which rotates the first and second pulleys, an ice making conveyor which is wrapped around the first and second pulleys and has a plurality of ice making parts concavely formed to contain water therein, an ice storage tray which is provided under the ice making conveyor to store ice cubes dropping from the ice making parts, and an ice level sensing unit which senses a level of the ice cubes stored in the ice storage tray, thus shutting off electricity.

The ice level sensing unit may include a sensing lever which moves up and down in a see-saw manner, a cam which is rotated by a force transmitted from the drive unit to move the sensing lever up and down, and a switch which is pressed by the sensing lever to turn on or off the electricity.

The sensing lever may comprise a bar of a predetermined length. The bar may include a hinge part which is provided at a middle portion of the bar to allow the bar to move up and down relative to the hinge part, a sensing part which is provided at a first side of the bar around the hinge part to be supported by the ice cubes stored in the ice storage tray, and a lever part which is provided at a second side of the bar opposite to the sensing part and is operated by the force of the drive unit transmitted through the cam to move the bar up and down.

The lever part may include, at an end thereof, a pressing part having a circular cross-section to be operated by the force of the drive unit transmitted through the cam, thus pressing the switch down.

The cam is rotated by the force of the drive unit transmitted through the first and second pulleys which are rotated by the drive unit. A projection part may be provided at a predetermined portion of the cam to apply the force to the lever part according to a rotating angle of the cam.

Further, the switch shuts off the electricity, when the switch is pressed down by the sensing lever over a predetermined period.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
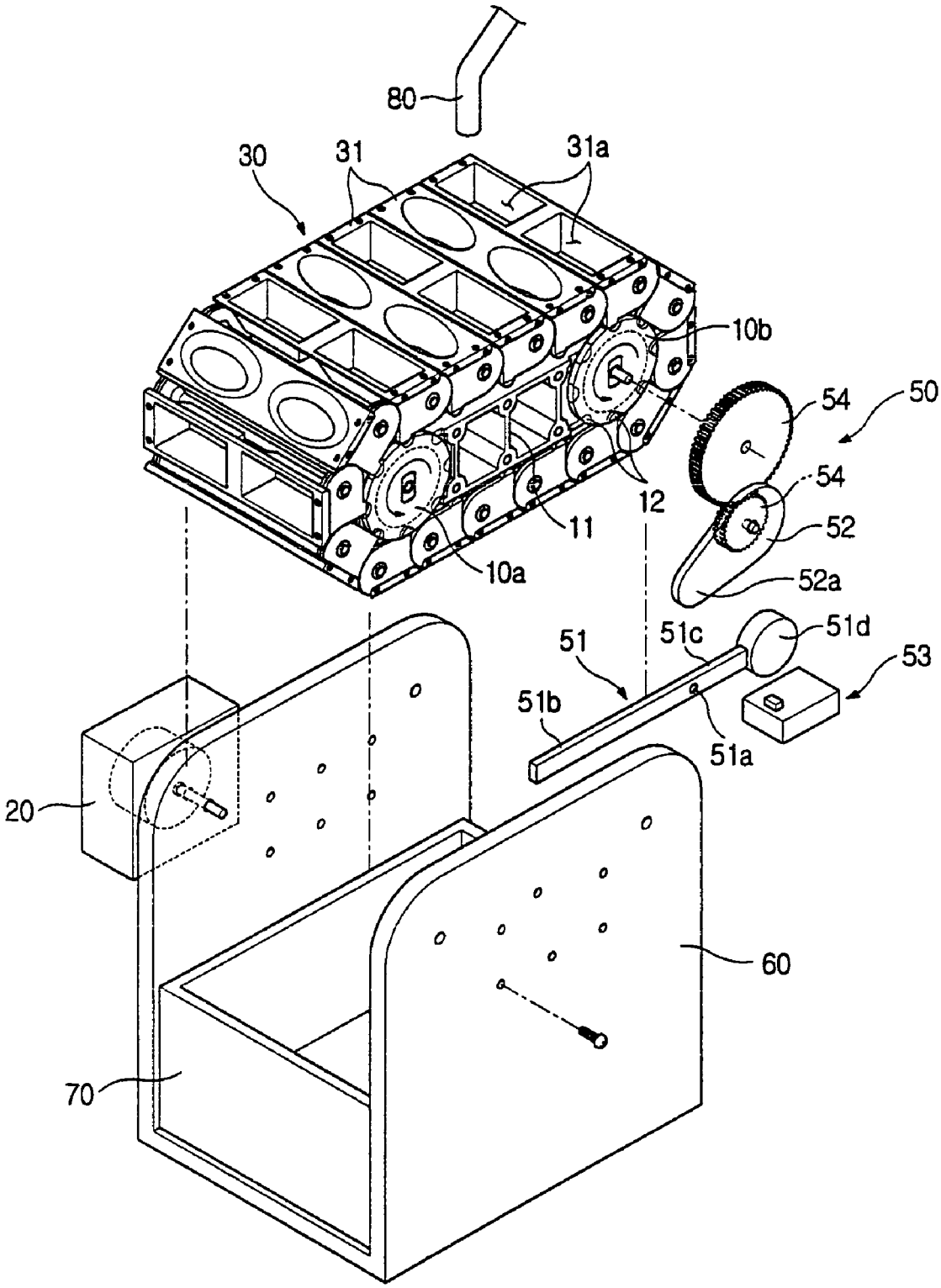
FIG. 1 is an exploded perspective view of an ice maker, according to an embodiment of the present invention.

Reference will now be made in detail to the present preferred embodiments of the present invention, examples of which are illustrated in the accompanying drawings, wherein like reference numerals refer to like elements throughout.

As shown in FIG. 1, an ice maker according to an embodiment of the present invention includes first and second pulleys 10*a* and 10*b* which are installed to be spaced apart from each other by a predetermined distance. A drive unit 20 rotates the first and second pulleys 10*a* and 10*b*. An ice making conveyor 30 is wrapped around the first and second pulleys 10*a* and 10*b*.

The first pulley 10*a* comprises a drive pulley 10*a* which is rotated by a force transmitted from the drive unit 20. The second pulley 10*b* comprises a driven pulley 10*b* which is rotated by the force transmitted from the first pulley 10*a* through the ice making conveyor 30. Between the drive and driven pulleys 10*a* and 10*b* is provided a support bracket 11. The drive and driven pulleys 10*a* and 10*b* are installed at opposite ends of the support bracket 11 to be spaced apart from each other by a predetermined distance.

The ice making conveyor 30 includes a plurality of tray cells 31 with concave ice making parts 31*a*. The tray cells 31 are hinged to each other to form the ice making conveyor 30 of a closed loop shape. Each of the ice making parts 31*a*, is made of a metal, such as stainless steel, thus allowing heat to be easily transferred to each of the ice making parts 31*a*.

An engaging projection 31*b* is projected from an inside portion of each of the tray cells 31 to be subject to the force transmitted from the drive pulley 10*a*. Further, a plurality of engaging holes 12 are provided on outer circumferential surfaces of the drive and driven pulleys 10*a* and 10*b* at regular intervals to engage with the engaging projections 31*b*. Thus, when the force is transmitted from the drive pulley 10*a* to the tray cells 31, via the engaging projections 31*b* and the engaging holes 12, the tray cells 31 rotate around the drive and driven pulleys 10*a* and 10*b*.

The ice maker also includes a heater 40 (see, FIG. 2) to apply heat to the ice making parts 31*a*. According to the embodiment of the present invention, the heater 40 is mounted to a lower portion of the support bracket 11 to apply heat to the tray cells 31 defining the ice making parts 31*a* which face downward.

The support bracket 11 is mounted at both ends thereof to an interior of a cooling compartment to install the ice maker in the cooling compartment. According to the embodiment of the present invention, a mounting bracket 60 is provided to hold both sides of the support bracket 11, thus supporting the ice making conveyor 30 in the cooling compartment.

An ice storage tray 70 is provided under the ice making conveyor 30 to store ice cubes made from the ice making parts 31*a*. A water supply pipe 80 is provided above the ice making conveyor 30 to supply water to the tray cells 31.

Further, the ice maker according to the present invention includes an ice level sensing unit 50 to sense a level of the ice cubes which are stored in the ice storage tray 70. Once the level of the ice cubes sensed by the ice level sensing unit 50 has reached a predetermined level, the ice maker stops making the ice cubes.

According to the embodiment of the present invention, the ice level sensing unit 50 measures the level of the ice cubes stored in the ice storage tray 70, thus detecting an amount of the ice. The ice level sensing unit 50 includes a sensing lever 51, a cam 52, and a switch 53. The sensing lever 51 is hinged at a middle portion thereof to the mounting bracket 60 to move up and down in a see-saw manner. The cam 52 moves the sensing lever 51 in the see-saw manner. The switch 53 is pressed by the sensing lever 51 to turn on or off the electricity which is applied to the ice maker.

The sensing lever 51 comprises a bar of a predetermined length. The bar includes a hinge part 51*a* which is hinged to the mounting bracket 60. A sensing part 51*b* is provided at a first side of the bar around the hinge part 51*a* to be supported by the ice cubes stored in the ice storage tray 70. A lever part 51*c* is provided at a second side of the bar which is opposite to the sensing part 51*b*, and is operated by the force of the drive unit 20 transmitted through the cam 52. At an end of the lever part 51*c* is provided a pressing part 51*d* to press the switch 53. The pressing part 51*d* has a circular cross-section so that the force of the drive unit 20 is easily transmitted from the cam 52 to the pressing part 51*d*.

A projection part 52*a* is provided at a predetermined portion of the cam 52 to be eccentric from a center of rotation of the cam 52. Thus, according to a rotating angle of the cam 52, the projection part 52*a* at specific angles transmits the force of the drive unit 20 to the pressing part 51*d* to move the pressing part 51*d*. Thereby, the pressing part 51*d* periodically presses the switch 53 down. In this case, the cam 52 is rotated by the rotating force transmitted from the drive unit 20. According to the embodiment of the present invention, the rotating force of the drive unit 20 is transmitted to the cam 52 through a pair of intermediate gears 54 connected to a shaft of the driven pulley 10*b* which is rotated by the ice making conveyor 30.

The switch 53 is installed under the pressing part 51*d* of the sensing lever 51 to be pressed by the pressing part 51*d* which is moved downward by the cam 52. When the switch 53 is kept pressed by the pressing parts 51*d*, the electricity supplied to the ice maker is shut off, thus stopping the operation of the ice maker.

According to the embodiment of the present invention, the cam 52 of the ice level sensing unit 50 is rotated by the rotating force transmitted from the drive unit 20 through the ice making conveyor 30 and the drive and driven pulleys 10*a* and 10*b*. Alternatively, the cam 52 may be rotated by a different drive unit without being limited to the above-mentioned embodiment.

The operation and effect of the ice maker according to the present invention will be described in the following in detail with reference to the attached drawings.

First, water is supplied through the water supply pipe 80 to the ice making parts 31*a* of the tray cells 31 which face upward. Since the ice maker is installed in the cooling compartment of a refrigerator, cool air is continuously supplied to the water which is contained in the ice making parts 31*a*. Thus, after a predetermined period, the water in the ice making parts 31*a* is converted into ice.

The ice making conveyor 30 is moved by the drive unit 20 and the drive and driven pulleys 10*a* and 10*b*, thus moving the ice cubes. In a detailed description, when the electricity is applied to the drive unit 20, the drive pulley 10*a* is rotated. At this time, the engaging holes 12 provided on the outer circumferential surface of the drive pulley 10*a* engage with the engaging projections 31*b* provided on the tray cells 31 to move the ice making conveyor 30. By the movement of the ice making conveyor 30, the ice making parts 31*a* having the ice cubes face downward.

In such a state, when electricity is applied to the heater 40, the heater 40 emits heat, thus applying the heat to the ice making parts 31*a* of the tray cells 31. Thus, the surfaces of the ice cubes which are in contact with the tray cells 31 defining the ice making parts 31*a* are heated, and eventually melted, thus breaking a holding force. At this time, the ice cubes drop due to gravity from the ice making parts 31*a* to be stored in the ice storage tray 60.

Figure 2:
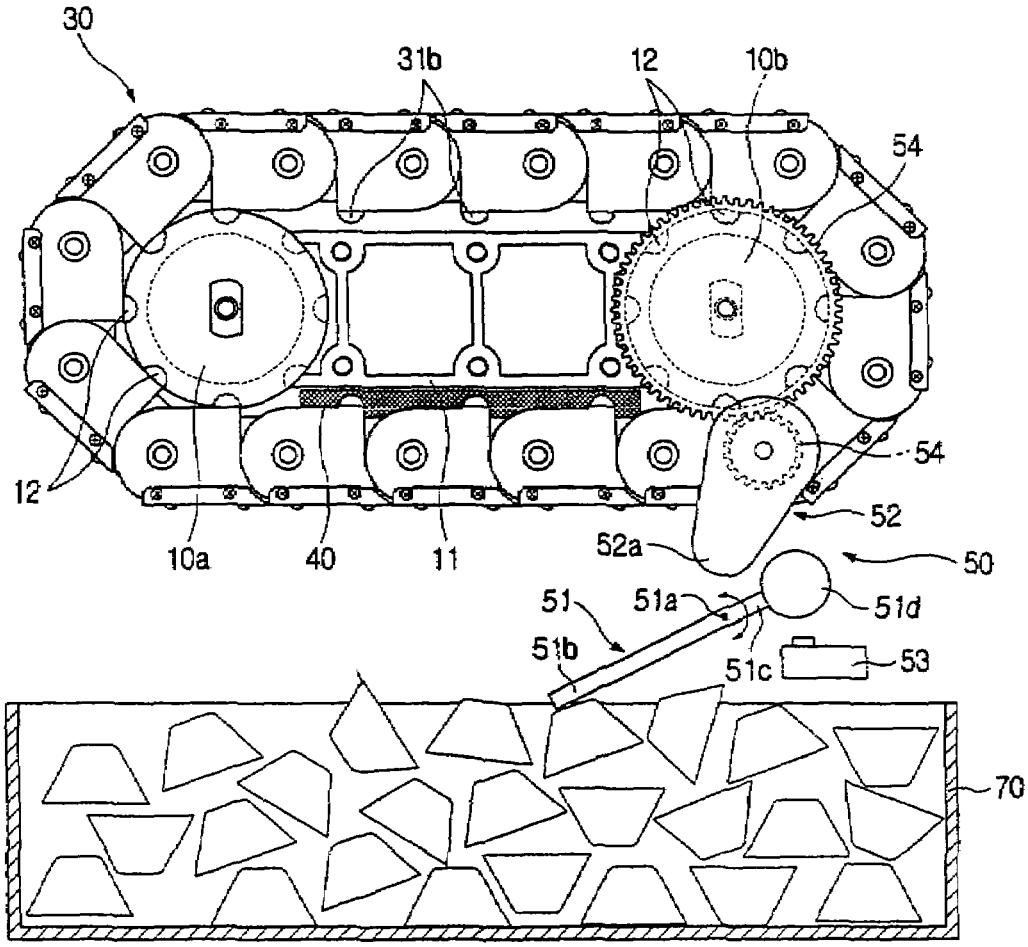
FIG. 2 is a side sectional view of the ice maker of FIG. 1.
Figure 3:
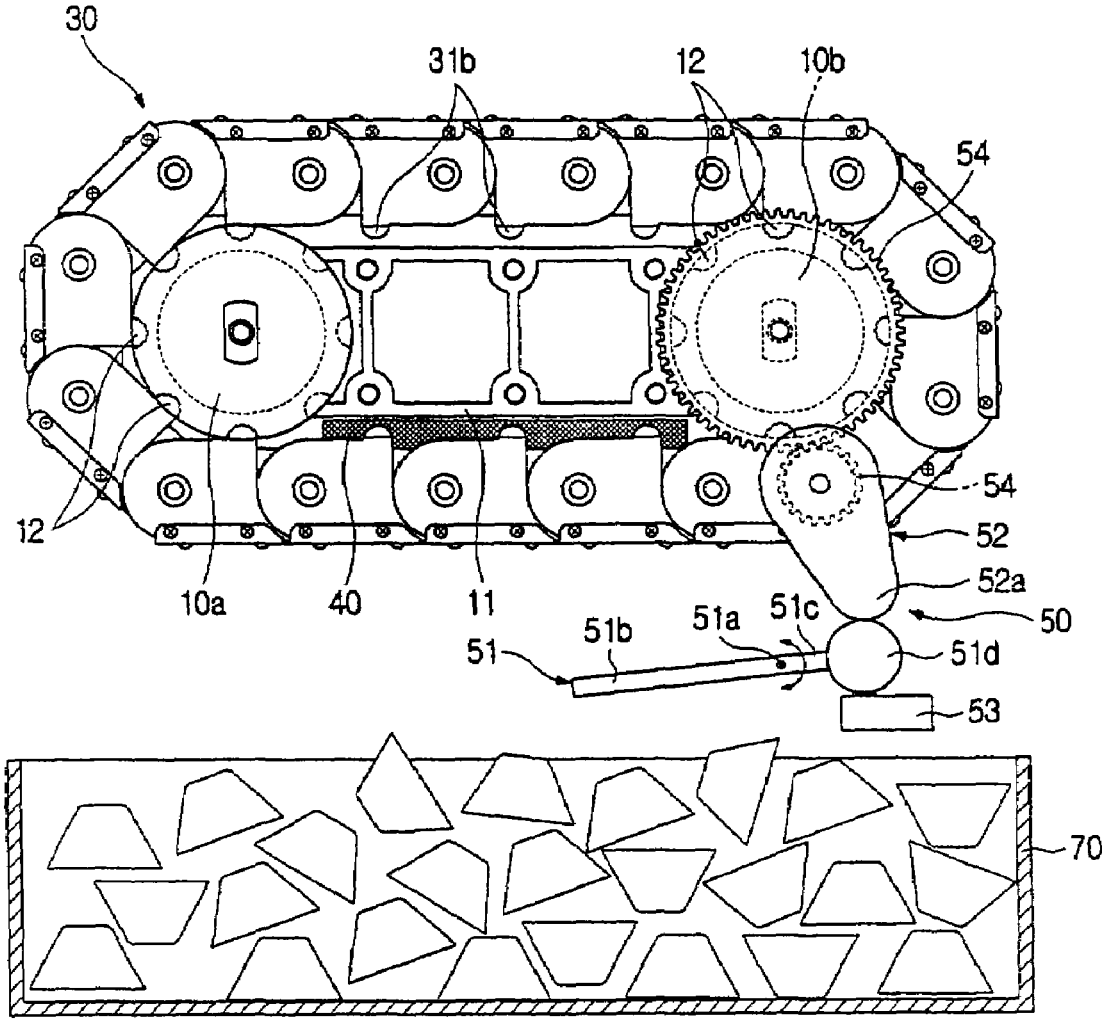
FIG. 3 is a side sectional view of the ice maker of FIG. 1, when an ice level sensing unit of the ice maker is operated.

While such an ice making operation is carried out, as shown in FIGS. 2 and 3, the cam 52 of the ice level sensing unit 50 is rotated by the force of the drive unit 20 transmitted through the driven pulley 10*b* and the intermediate gears 54, thus applying the force transmitted to the cam 52 to the pressing part 51*d* of the sensing lever 51. At this time, the sensing lever 51 moves in the see-saw manner while periodically pressing the switch 53.

Figure 4:
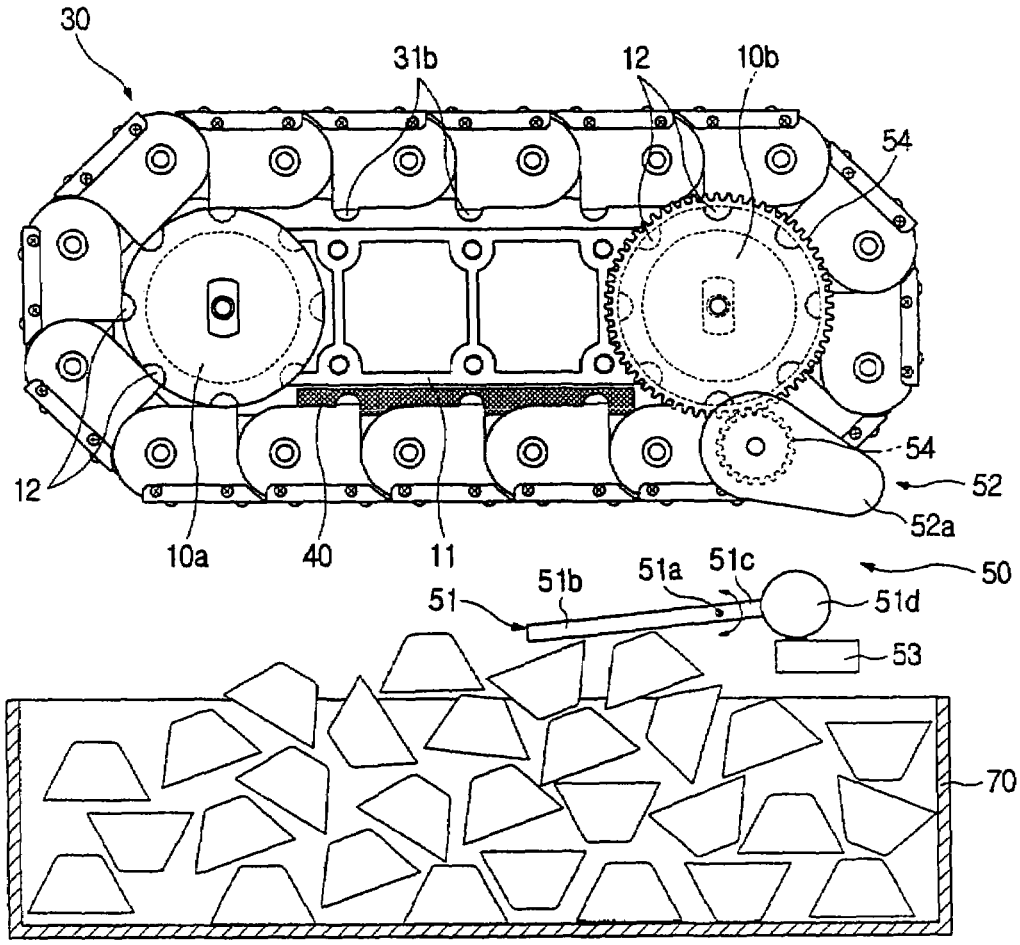
FIG. 4 is a side sectional view of the ice maker of FIG. 1, when an ice storage tray of the ice maker is filled with ice cubes.

When the ice making operation is continuously carried out and the level of the ice cubes stored in the ice storage tray 60 reaches a predetermined level, as shown in FIG. 4, the sensing part 51*b* of the sensing lever 51 which moves up and down in the see-saw manner, is supported by the ice cubes. At this time, the sensing part of the sensing lever 51 does not move downward. Further, the pressing part 51*d* provided at the second side of the sensing lever 51 which is opposite to the sensing part 51*b*, keeps on pressing the switch 53 down. When such a state is continued for a predetermined period, the switch 53 shuts off the electricity which is supplied to the ice maker, thus stopping the ice production.

As apparent from the above description, the present invention provides an ice maker, which is provided with an ice level sensing unit to measure a level of ice cubes stored in an ice storage tray, thus stopping an operation of the ice maker when the level of the ice cubes stored in the ice storage tray exceeds a predetermined level, therefore preventing an excessive number of ice cubes from being stored in the ice storage tray.

Although a preferred embodiment of the present invention has been shown and described, it would be appreciated by those skilled in the art that changes may be made in these embodiments without departing from the principles and spirit of the invention, the scope of which is defined in the claims and their equivalents.

What is claimed is:

1. An ice maker powered by electricity, comprising:

first and second pulleys installed to be spaced apart from each other;

a drive unit to rotate the first and second pulleys, said drive unit including a motor;

an ice making conveyor wrapped around the first and second pulleys, and having a plurality of ice making parts which are concavely formed to contain water therein; and an ice storage tray provided under the ice making conveyor to store ice cubes dropping from the ice making parts; and an ice level sensing unit movably connected to the drive unit of the ice maker to sense a level of the ice cubes stored in the ice storage tray, wherein the ice level sensing unit includes a switch electrically connected to the motor;

a sensing lever having a first end and a second end and the ends moving up and down in a see-saw manner between a first position wherein the first end is moved upward by a predetermined amount of ice in the ice storage tray and the second end is moved towards the switch, and a second position wherein the first end is moved downward and the second end is moved away from the switch;

a cam rotated by a force transmitted from the drive unit to directly contact and urge the second end of the sensing lever down to press against the switch, when the sensing lever is in the first position and turn off the electricity to the ice maker, wherein the switch shuts off the electricity, when the switch is pressed by the sensing lever over a predetermined period.

2. The ice maker according to claim 1, wherein the sensing lever comprises a bar of a predetermined length, the bar comprising:

a hinge part provided at a middle portion of the bar to allow the bar to move up and down relative to the hinge part;

a sensing part provided at the first end of the bar around the hinge part to be supported by the ice cubes stored in the ice storage tray; and a lever part provided at the second end of the bar which is opposite to the sensing part, the lever part being operated by the force of the drive unit transmitted through the cam to move the bar up and down.

3. The ice maker according to claim 2, wherein the second end of the sensing lever has a circular cross-section.

4. The ice maker according to claim 2, wherein a projection part is provided at a predetermined portion of the cam to apply the force to the lever part according to a rotating angle of the cam.

5. The ice maker according to claim 1, wherein the sensing lever is linear.

* * * * *

UNITED STATES PATENT AND TRADEMARK OFFICE

CERTIFICATE OF CORRECTION

PATENT NO. : 7,013,657 B2
APPLICATION NO. : 10/724168
DATED : March 21, 2006
INVENTOR(S) : Ji Sick Hwang et al.

It is certified that error appears in the above-identified patent and that said Letters Patent is hereby corrected as shown below:

On the Cover Page, second column, under the "U.S. PATENT DOCUMENTS" section, second reference, change "Jocobs" to --Jacobs--.

Signed and Sealed this

Eighth Day of August, 2006

JON W. DUDAS
*Director of the United States Patent and Trademark Office*